United States Patent [19]

Christian

[11] 4,406,800

[45] Sep. 27, 1983

[54] GREASE COMPOSITION CONTAINING POLY(ALPHA-OLEFIN)

[75] Inventor: John B. Christian, Yellow Springs, Ohio

[73] Assignee: The United States of America as represented by the Secretary of the Air Force, Washington, D.C.

[21] Appl. No.: 326,973

[22] Filed: Mar. 23, 1982

[51] Int. Cl.[3] ..... C10M 3/44

[52] U.S. Cl. ..... 252/28; 252/33.6; 252/56 S; 252/49.6; 252/21

[58] Field of Search ..... 252/28, 33.6, 56 S, 252/49.6, 21

[56] References Cited

U.S. PATENT DOCUMENTS

| | | | |
|---|---|---|---|
| 3,622,512 | 11/1971 | Christian | 252/21 |
| 3,642,626 | 2/1972 | Christian | 252/33.6 |
| 3,814,689 | 6/1974 | Christian | 252/21 |
| 3,876,720 | 4/1975 | Heilman et al. | 260/677 R |
| 4,065,395 | 12/1977 | Bailey | 252/25 |
| 4,094,799 | 6/1978 | De Vries et al. | 252/29 |
| 4,098,708 | 7/1978 | Stuebe | 252/51.5 A |
| 4,317,737 | 3/1982 | Oswald et al. | 252/28 |

*Primary Examiner*—Jacqueline V. Howard

*Attorney, Agent, or Firm*—Donald J. Singer; Charles E. Bricker

[57] ABSTRACT

An extreme pressure grease composition capable of limiting temperature increase comprising a poly(alpha-olefin) as a base fluid and a tetralkyl ammonium smectite clay as a thickener. Antimony dialkyldithiocarbamate and molybdenum disulfide may be added to the grease composition as an extreme pressure inhibitor.

10 Claims, No Drawings

GREASE COMPOSITION CONTAINING POLY(ALPHA-OLEFIN)

RIGHTS OF THE GOVERNMENT

The invention described herein may be manufactured and used by or for the Government of the United States for all governmental purposes without the payment of any royalty.

BACKGROUND OF THE INVENTION

The present invention relates to an extreme pressure grease composition and, more particularly, to a grease composition containing a poly(alpha-olefin).

The need for high performance grease compositions capable of supplying good wear properties over a broad temperature range and under extreme pressures is well established. Such lubricants find their principal application in high speed aircraft and aerospace vehicles.

Christian, U.S. Pat. Nos. 3,642,626; 3,622,512; and 3,814,689 disclose grease formulated from polyol aliphatic esters, fluorinated polysiloxanes and polyol aliphatic ester/fluorinated polysiloxane blends. While these greases have been useful as extreme pressure antiwear lubricants at temperatures ranging from −100° F. to as high as 450° F., their utility has been restricted due to their inability to prevent temperature increases. As a result, they are not well suited for use in transmission applications where the ability of a grease to dissipate heat and prevent heat generation is critical.

Heilman et al, U.S. Pat. No. 3,876,720 discloses a class of olefins (herein referred to as poly(alpha-olefins)) which are dimers of vinylidene compounds. Heilman states that these olefins are useful as engine lubricants, hydraulic fluids and grease bases useful under extreme pressure conditions. However, while Heilman recognizes this utility for the olefins, the patent does not disclose any grease compositions as such.

Thus, none of the prior art teachings, including Heilman and Christian, disclose a grease composition that has heat dissipation and heat prevention properties and is useful as a transmission grease over a broad temperature range and under extreme pressure conditions. Accordingly, the need remains for such a great composition.

SUMMARY OF THE INVENTION

A principal object of the present invention is to provide a lubricant which is capable of yielding good wear properties over a wide temperature range under extreme pressure conditions and minimize temperature increases within the lubricant during use.

A more particular object of the present invention is to provide a grease composition which is capable of providing antiwear properties at temperatures ranging from as low as −100° F. to as high as 450° F. and is suitable as a transmission grease in high speed aircraft.

A still more particular object of the present invention is to provide a grease composition having heat dissipation properties and which helps prevent heat generation.

These and other objects are attained in the present invention which provides a grease composition comprising a poly(alpha-olefin) as a base fluid and tetraalkyl ammonium smectite clay as a thickener. It has been found that grease compositions combining this fluid and thickener are able to maintain a film at high temperatures, prevent wear and reduce heat build-up.

In addition to the aforementioned basic grease composition, compositions are also provided in the present invention wherein in admixture with poly(alpha-olefin), the grease contains a polyol aliphatic ester and/or a fluorinated polysiloxane as the base fluid. Furthermore, the invention also provides grease compositions which combine poly(tetrafluoroethylene) (hereafter PTFE) and/or a fluorinated ethylene-propylene copolymer with tetraalkyl ammonium smectite clay as a thickener.

Another class of invention grease compositions combines the aforementioned base fluid(s) and thickener(s) with a so-called pressure enhancing agent. The latter agent may be either or both antimony dialkyldithiocarbamate and molybdenum disulfide.

The foregoing embodiments of the invention are described below in more detail.

DETAILED DESCRIPTION OF THE INVENTION

The poly(alpha-olefins) used in the present invention are represented by the formula I:

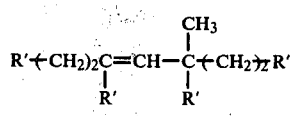

I wherein $R^1$ represents a saturated alkyl group having 4 to 12 carbon atoms. These compounds are generally disclosed in Heilman et al, U.S. Pat. No. 3,876,720. The poly(alpha-olefins) preferably used in the present invention have a kinematic viscosity of about 5 to 35 cs, preferably 18–33 cs, and more precisely 32 cs at 100° F. These compounds are commercially available from Gulf Oil Chemicals Co., Houston, Texas in viscosities of 18 and 32 cs under the trademark Synfluids. The 32 cs composition is made up of 30% C-30 olefins, 50% C-40 olefins and 20% C-50 (carbon number) olefins, approximately (unless otherwise stated all percentages are by weight). The 18 cs composition is also useful in the invention, though less preferred, and is a mixture comprising approximately 85 to 90% C-30 olefins and the balance C-40 olefins.

Generally, the base fluid constitutes approximately 70 to 90% of the invention greases. Where the poly(alpha-olefin) is used alone as the base fluid it is typically present in an amount of about 80 to 90%.

The base fluid may also contain a polyol aliphatic ester and/or a fluorinated polysiloxane. When these materials are present, the poly(alpha-olefin) and the aliphatic ester are usually used in approximately equal amounts, e.g., in a weight ratio of ester to olefin of about 0.8 to 1.2. When fluorinated polysiloxane is present, the base fluids are preferably used in a weight ratio (polysiloxane to olefin) of $\frac{1}{2}$ to $\frac{2}{3}$.

Polyol aliphatic esters of the type useful in the present invention are disclosed in Christian, U.S. Pat. No. 3,622,512. These esters are represented by the formula II:

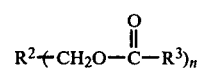

II wherein $R^2$ is a substituted alkane having 1 to 3 carbon atoms, $R^3$ is an alkyl group having 3 to 12 carbon atoms, and n is an integer of 3 or 4. Preferably the polyol aliphatic ester also has a viscosity at 100° F. of about 25–35 cs, a viscosity at 210° F. of about 4 to 6 cs, a pour point of about −70° F. and a flash point of about 450° to 525° F. Such esters are commercially available from Stauffer Chemical Co., Westport, Connecticut as Stauffer Blends 7792 and 7791.

Fluorinated polysiloxanes which can be used in the base fluid of the present invention are represented by the formula III:

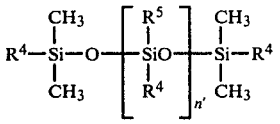

III where $R^5$ is hydrogen or an aliphatic hydrocarbon radical having 1 to 3 carbon atoms (e.g., methyl, ethyl, etc.), $R^4$ is a substituent selected from the group consisting of methyl, ethyl, vinyl, phenyl and $—CH_2CH_2R^6$ where $R^6$ is a perfluoroalkyl group having 1 to 10 carbon atoms, at least one-half of the $R^4$ substituents being $—CH_2CH_2R^6$, and n′ is an integer in the range of 1 to 150 and preferably n′ is in the range 40 to 150. Fluorinated polysiloxanes of the formula III having a viscosity of about 50 to 100 cs and preferably 65 to 85 cs at 100° F. are preferred. These viscosities are obtained by controlling n′ within the above preferred range. Mixtures of fluorinated polysiloxanes of the formula III can also be used and sometimes they are preferred.

Fluorinated polysiloxane of the formula III and their synthesis are disclosed in U.S. Pat. No. 2,961,424.

A preferred polysiloxane for use in the present invention is represented by the formula IV:

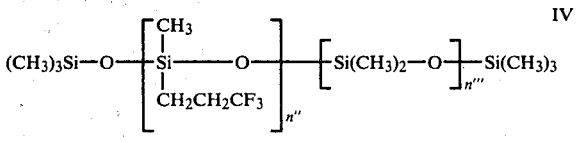

IV where n″ and n‴ are in the range of 20 to 75. The siloxane groups may be random, alternating or in block with n″ and n‴ being approximately equal and providing a viscosity in the aforementioned ranges. This compound is commercially available under the name Q 5-0161 from Dow Corning Corporation, Midland, Michigan.

Another preferred polysiloxane is represented by the formula V:

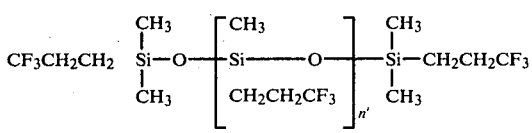

V where n′ is defined as in formula III. This compound is available from Dow Corning Corporation, Midland, Michigan, under the trademark FS 1265.

A base fluid comprising the poly (alpha-olefin) above or in combination with the polyol aliphatic esters or polysiloxanes described above is mixed with a tetraalkyl ammonium smectite clay. This clay may be used as the sole thickener or it may be combined with PTFE or fluorinated ethylene propylene copolymer.

The thickener may be present in the invention grease composition in an amount of 10 to 30% and preferably 10 to 20%, depending on the nature of the base fluids. When tetraalkyl ammonium smectite clay is used in combination with PTFE or the fluorinated ethylene propylene copolymer, the clay is usually present in an amount of about 6 to 10% with the additional thickener bringing the total amount of thickener to within the aforementioned ranges. The examples which follow more clearly illustrate the relationship between the thickeners, their amounts and the base fluids.

The tetraalkyl ammonium smectite clay thickener preferably used in the invention has a mean particle size of about 0.3 to 1.0 microns, a surface area of about 15.5 to 16.0 $m^2/g$ and a density of approximately 3.10 gcc. This material is commercially available from NL Industries under the label Baragel 24.

When a fluorinated ethylenepropylene copolymer is used with the clay, the copolymer should have a surface area of about 10.0 $m^2/g$, a particle size of about 0.15 micron, a density of about 2.39 to 2.47 g/cc, and an average molecular weight of about 120,000 to 190,000 (preferably 140,000 to 160,000). One fluorinated ethylenepropylene copolymer having these properties and useful in the present invention is TL-120 from Liquid Nitrogen Processing Co., Malvern, Pennsylvania. Similarly the PTFE thickeners used in the invention should have a particle size of about 1 micron to 2 microns, a molecular weight of 2,000 to 50,000 (preferably 10,000 to 50,000), a density of 2.15 to 2.28 g/cc and a surface area of about 7.0 to 8.0 $m^2/g$. One PTFE useful in the invention is TL-102 from the aforesaid Liquid Nitrogen Processing Co.

The grease compositions of the present invention are preferably inhibited for extreme pressure applications by the addition of antimony dialkyldithiocarbamate alone or in combination with molybdenum disulfide. Representative examples of the thiocarbamate include the di-n-butyl, di-amyl, dihexyl, di-2-ethylhexyl and didecyl compounds, with antimony diamyldithiocarbamate being most preferred. One commercially available carbamate useful in the invention is Vanlube 73 from R. T, Vanderbilt Co., Norwalk, Connecticut.

Antimony dialkyldithiocarbamate is added in an amount sufficient to give the grease suitable extreme pressure characteristics. Typically the amount ranges from 2 and 6% depending on the composition of the balance of the grease and whether molybdenum disulfide is also present. When molybdenum disulfide is present, it is used in an amount up to approximately 3%. Molykote Z from Climax Molybdenum Co., Detroit, Michigan, is suitable for use in the present invention.

The grease compositions of the present invention can be blended using any standard grease homogenizing apparatus. For example, the ingredients can be mixed thoroughly and blended to a grease consistency by passing 3 to 5 times through a 3-roll paint mill with the rollers set at 0.002 inch at room temperature (71° F.).

The grease compositions of the present invention are further illustrated by the following non-limiting examples:

EXAMPLES

The grease compositions shown in Table I below were blended by passing the tabulated compounds twice through a three-roll mill with rollers set at a spacing of 0.0015 to 0.002 inch at 77° F.

TABLE 1

| | Parts (wt). |
|---|---|
| Example 1 | |
| Poly(alpha-olefin) (32 cs Gulf Synfluid)[1] | 90 |
| Tetraalky ammonium smectite clay (Baragel - 24) | 10 |
| Example 2 | |
| Poly(alpha-olefin (18 cs Gulf Synfluid)[2] | 80 |
| Tetraalkyl ammonium smectite clay (Baragel - 24) | 20 |
| Example 3 | |
| Poly(alpha-olefin) (32 cs Gulf Synfluid)[1] | 44 |
| Polyol aliphatic ester (Stauffer Blend 7792) | 44 |
| Tetraalkyl ammonium smectite clay (Baragel - 24) | 9 |
| Polytetrafluoroethylene (TL-102) | 3 |
| Example 4 | |
| Poly(alpha-olefin) (32 cs Gulf Synfluid)[1] | 44 |
| Polyol aliphatic ester (Stauffer Blend 7792) | 44 |
| Tetraalkyl ammonium smectite clay (Baragel - 24) | 9 |
| Fluorinated ethylenepropylene copolymer (TL-120) | 3 |
| Example 5 | |
| Poly(alpha-olefin) (32 cs Gulf Synfluid)[1] | 84 |
| Tetraalkyl ammonium smectite clay (Baragel - 24) | 13 |
| Antimony dialkyldithiocarbamate (Vanlube - 73) | 3 |
| Example 6 | |
| Poly(alpha-olefin) (18 cs Gulf Synfluid)[2] | 76 |
| Tetraalkyl ammonium smectite clay (Baragel - 24) | 17 |
| Molybdenum disulfide | 5 |
| Antimony dialkyldithiocarbamate (Vanlube - 73) | 2 |
| Example 7 | |
| Poly(alpha-olefin) (32 cs Gulf Synfluid)[1] | 41.5 |
| Polyol aliphatic ester (Stauffer Blend 7791) | 41.5 |
| Tetraalkyl ammonium smectite clay (Baragel - 24) | 12.0 |
| Molybdenum disulfide | 3.0 |
| Antimony dialkyldithiocarbamate (Vanlube - 73) | 2.0 |
| Example 8 | |
| Poly(alpha-olefin) (32 cs Gulf Synfluid)[1] | 48 |
| Fluorinated polysiloxane (Dow Corning Q5-0161) | 25 |
| Polytetrafluoroethylene (TL-102) | 15 |
| Tetraalkyl ammonium smectite clay (Baragel - 24) | 7 |
| Antimony dialkyldithiocarbamate (Vanlube - 73) | 5 |

TABLE 1-continued

| | Parts (wt). |
|---|---|
| Example 9 | |
| Poly(alpha-olefin) (32 cs Gulf Synfluid)[1] | 48 |
| Fluorinated polysiloxane (Dow Corning Q5-0161) | 25 |
| Fluorinated ethylenepropylene copolymer (TL-120) | 15 |
| Tetraalkyl ammonium smectite clay (Baragel - 24) | 7 |
| Antimony dialkyldithiocarbamate (Vanlube - 73) | 5 |

Notes:
[1]A mixture comprising approximately 30% C-30 olefin, 50% C-40 olefin and 20% C-50 olefin
[2]A mixture comprising approximately 85-90% C-30 olefin and the balance C-40 olefin Each composition was tested for penetration, steel on steel wear, evaporation loss, dropping point, oil separation and rubber swell. The results are shown and compared in Table 2 below and they demonstrate the lubricity of the invention grease composition and its ability to maintain low temperatures.

| | Example No. | | | | | | | | |
|---|---|---|---|---|---|---|---|---|---|
| | 1 | 2 | 3 | 4 | 5 | 6 | 7 | 8 | 9 |
| Penetration ($10^{-4}$ml)(1) | 296 | 335 | 315 | 315 | 303 | 339 | 315 | 347 | 347 |
| Steel-on-steel wear (mm0)(2) | 0.75 | 0.79 | 0.80 | 0.84 | 0.69 | 0.70 | 0.78 | 0.82 | 0.85 |
| (Fmax)(6) | (131) | (133) | (131) | (131) | (131) | (135) | (131) | (135) | (135) |
| Evaporation loss (%)(3) | 0.6 | 4.6 | 2.5 | 2.5 | 3.8 | 3.2 | 2.5 | 3.0 | 3.2 |
| Dropping point (°F.) | 510 | 605 | 550 | 550 | 580 | 545 | 680 | 560 | 560 |
| Oil separation (%)(4) | 9.9 | 7.9 | 1.6 | 1.6 | 7.0 | 7.0 | 1.6 | 6.1 | 6.1 |
| Rubber swell (%)(5) | 3.0 | 4.5 | 26.8 | 27.0 | 4.0 | 4.0 | 26.8 | 6.7 | 6.7 |

(1)60 double strokes
(2)1200 rpm, 40 kg load, 167° F., 2 hours, 52-100 steel
(3)22 hours at 300° F.
(4)30 hours at 300° F.
(5)"L" stock rubber, 168 hours at 158° F.
(6)1200 rpm, 40 kg load, ambient temperature, 4 hours, 52-100 steel In the above example, penetration was tested in accordance with ASTM Publication D217. Steel on steel wear was tested and measured in accordance with ASTM D2266. Evaporation loss was measured by ASTM D972 and dropping points were determined in accordance with ASTM D566. The rubber swell test was conducted in accordance with Federal Testing Method Standard No. 791a-3603. The temperature maximum in the steel on steel wear test was measured per ASTM D2266.

Having described the invention in detail and by reference to specific embodiments thereof, it will be apparent that numerous variations are possible without departing from the spirit and scope of the following claims.

What is claimed is:

1. A grease composition comprising:

(a) about 70 to 90 percent by weight of a poly(alpha-olefin) base fluid of the formula I:

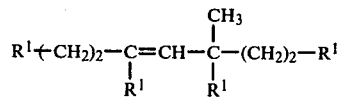

I wherein $R^1$ is an alkyl group having 4 to 12 carbon atoms; and (b) about 10 to 30 percent by weight of a thickener including a tetraalkyl ammonium smectite clay.

2. The composition of claim 1 additionally comprising at least one other thickener selected from the group consisting of poly(tetrafluoroethylene) and fluorinated ethylene propylene copolymer.

3. The composition of claim 1 additionally comprising about 2 to 6 percent of antimony dialkyldithiocarbamate.

4. The composition of claim 3 additionally comprising up to about 3 weight percent of molybdenum disulfide.

5. A grease composition comprising:

a. from about 70 to about 90 weight percent of a base fluid consisting of (1) a poly(alpha-olefin) of the formula I

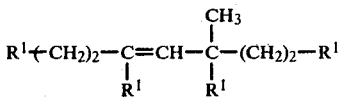

I wherein $R^1$ is an alkyl group having 4 to 12 carbon atoms, and (2) at least one other fluid selected from the group consisting of (a) a polyol aliphatic ester of the formula II

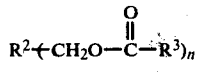

II wherein $R^2$ is a substituted alkane having 1 to 3 carbon atoms, $R^3$ is an alkyl group having 3 to 12 carbon atoms and n is 3 or 4, and (b) a fluorinated polysiloxane of the formula III:

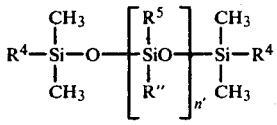

III wherein $R^4$ is selected from the group consisting of methyl, ethyl, vinyl, phenyl or $—CH_2CH_2R^6$, wherein $R^5$ is hydrogen or an aliphatic hydrocarbon radical, wherein $R^6$ is a perfluoroalkyl group having 1 to 10 carbon atoms, and wherein n' is an integer in the range of 1 to 150;

wherein the weight ratio of I to II is in the range of about 1:0.8 to 1:1.2 and the weight ratio of I to III is in the range of 2:1 to 3:2; and b. from about 10 to about 30 weight percent of thickener including tetraalkyl ammonium smectite clay.

6. The grease composition of claim 5 additionally comprising at least one other thickener selected from the group consisting of ethylenepropylene copolymer and polytetrafluoroethylene, wherein the amount of said clay is about 6 to 10 weight percent and the amount of said other thickener is about 4 to 20 weight percent.

7. The grease composition of claim 5 additionally comprising about 2 to 6 percent of antimony dialkyldithiocarbamate.

8. The grease composition of claim 7 additionally comprising up to 3 percent of molybdenum disulfide.

9. The grease composition of claim 6 additionally comprising about 2 to 6 percent of antimony dialkyldithiocarbamate.

10. The grease composition of claim 9 additionally comprising up to 3 percent of molybdenum disulfide.

* * * * *